US005815177A

United States Patent [19]

Sasaki

[11] Patent Number: 5,815,177

[45] Date of Patent: Sep. 29, 1998

[54] INK SPREADING GROOVES FORMED FOR SPREADING AND DRYING INK DRIPPED DOWN FROM NOZZLES OF INK JET RECORDING DEVICE

[75] Inventor: Toyonori Sasaki, Anjo, Japan

[73] Assignee: Brother Kogyo Kabushiki Kaisha, Nagoya, Japan

[21] Appl. No.: 706,399

[22] Filed: Aug. 29, 1996

[30] Foreign Application Priority Data

Aug. 30, 1995 [JP] Japan ..... 7-246691

[51] Int. Cl.[6] ..... B41J 2/135; B41J 2/165

[52] U.S. Cl. ..... 347/44; 347/33; 347/22

[58] Field of Search ..... 347/44, 33, 34, 347/36, 22, 64

[56] References Cited

U.S. PATENT DOCUMENTS 3,776,461 12/1973 Kashio ..... 347/22

5,381,169 1/1995 Arai et al. ..... 347/33

FOREIGN PATENT DOCUMENTS 2754630 6/1979 European Pat. Off. ..... 347/33

2286349 11/1990 Japan ..... 347/33

*Primary Examiner*—N. Le

*Assistant Examiner*—Thinh Nguyen

*Attorney, Agent, or Firm*—Oliff & Berridge, PLC

[57] ABSTRACT

A recording head of an ink jet recording device is surrounded by a protection member so as to expose a nozzle plate attached to the recording head. A plurality of ink spreading grooves are formed in the protection member for receiving residual ink clinging to the surface of the nozzle plate. The ink introduced into the grooves spread therealong by capillary action of the grooves and thus dried quickly. The grooves are, for example, in a square mesh pattern.

30 Claims, 6 Drawing Sheets

INK SPREADING GROOVES FORMED FOR SPREADING AND DRYING INK DRIPPED DOWN FROM NOZZLES OF INK JET RECORDING DEVICE

BACKGROUND OF THE INVENTION

1. Field of the Invention

The present invention relates to an ink jet recording device for recording images with ink droplets ejected from ink ejection nozzles. More particularly, the invention relates to an ink jet recording device wherein ink dripped down from the nozzles following the surface of a recording head is introduced into grooves extending vertically and horizontally in a mesh pattern to spread the ink along the grooves and to dry the ink quickly.

2. Description of the Prior Art

Ink jet printers have been conventionally used wherein ink droplets are ejected from a plurality of nozzles formed in a recording head. The recording head integrally formed with a tubular joint manifold is mounted on a head holder. An ink cartridge is also detachably mounted on the head holder so that ink contained in the ink cartridge is supplied through the joint manifold to the recording head.

In such ink jet printers, ink mist produced resulting from repeated ejections of ink droplets from the respective ones of the nozzles adhere to the ink ejection surface of the recording head. The ink mist grows into an ink droplet, and the resultant ink droplet is dripped down from the recording head. The ink droplet on the ink ejection surface may be wiped off by a wiper blade, but some may remain unwiped and dripped down from the recording head. The ink thus dripped down smudges a frame or a recording paper disposed downwardly of the recording head.

Japanese Examined Patent Publication (Kokoku) No. Sho-49-26730 discloses attaching a tubular ink guide member for capturing ink not subject to printing. As shown in FIGS. 1(*a*) and 1(*b*), the ink guide member 124 is attached to the end surface of a holder 123 that supports a nozzle 120. An acceleration electrode 121 and a deflection electrode 122 are disposed between the nozzle 120 and the holder 123. The ink continuously ejected from the nozzle 120 and accelerated by the acceleration electrode 121 is deflected in accordance with a print signal. Ink not subject to printing is directed toward the lower portion A of the aperture formed at the front end surface of the ink guide member 124. The tubular ink guide member 124 is formed with a groove 125 in the outer periphery thereof and vertical slits 128 in the front end portion of the ink guide member 124. The slits 128 have a depth that reaches the groove 125. The ink directed to the portion A is guided toward the groove 125 by capillary action of the slits 128.

However, in the structure shown in FIGS. 1(*a*) and 1(*b*), the ink filled in the groove 125 may drop when the holder 123 accidentally vibrates for some reasons. As a result, a frame or a printing paper located beneath the holder 123 is smudged by the ink dropped from the groove 125. Even if an ink vessel 130 were provided below the holder 123 to receive the ink from the groove 125, the ink vessel 130 must have a long width to ensure capturing of the ink.

SUMMARY OF THE INVENTION

In view of the foregoing, an object of the present invention is to provide an ink jet recording device wherein ink does not drip down from ejection nozzles of a recording head to thus prevent a frame or a recording paper disposed beneath the recording head from being smudged by the ink.

In order to achieve the above and other objects, there is provided an ink jet recording device including a recording head having a nozzle plate attached thereto, and a protection member surrounding the recording head so as to expose the surface of the nozzle plate, wherein a plurality of ink spreading grooves are formed in at least a part of the outer surface of the protection member. The plurality of ink spreading grooves receive residual ink clinging to the surface of the nozzle plate and spread the residual ink therealong by capillary action of the grooves. To spread the residual ink introduced into the grooves, the ink spreading grooves are formed to be continuous with one another. As a result, the surface area of the residual ink contacting air is increased and thus the ink is dried quickly.

The outer surface of the protection member has a flat portion below the position of the nozzle plate and is substantially flush with the surface of the nozzle plate, wherein the flat portion is formed with the plurality of ink spreading grooves for receiving residual ink trickling down the surface of the nozzle plate.

The outer surface of the protection member has a bottom surface substantially perpendicular to the surface of the nozzle plate, wherein the plurality of ink spreading grooves further extend to the bottom surface.

In a structure where a wiping member is provided for wiping the residual ink clinging on the surface of the nozzle plate, the plurality of ink spreading grooves further extend to side surfaces of the protection member which are substantially perpendicular to the surface of the nozzle plate in order to receive the residual ink wiped by the wiping member.

The plurality of ink spreading grooves are in a mesh pattern forming a plurality of closed non-groove areas surrounded by the plurality of ink spreading grooves wherein each of the plurality of closed non-groove areas may be a square shape, a rectangular shape, a parallelepiped shape, a triangular shape, or a circular shape.

BRIEF DESCRIPTION OF THE DRAWINGS

The particular features and advantages of the invention as well as other objects will become more apparent from the following description taken in connection with the accompanying drawings, in which:

FIG. 1(*b*) is a perspective view showing the conventional ink jet printer shown in FIG. 1(*a*);

DETAILED DESCRIPTION OF THE PREFERRED EMBODIMENTS

A preferred embodiment of the present invention will be described with reference to the accompanying drawings. The embodiment to which the present invention is applied pertains to an ink jet recording device having a recording head for ejecting ink droplets toward a recording medium to thus record an image on a recording paper. The ink used for recording is contained in an ink cartridge that is detachably mounted on the recording head.

The expression "front", "rear", "above", "below", "right" and "left" are used through the description to define the various parts when the printer is disposed in an orientation in which it is intended to be used.

Figure 1:
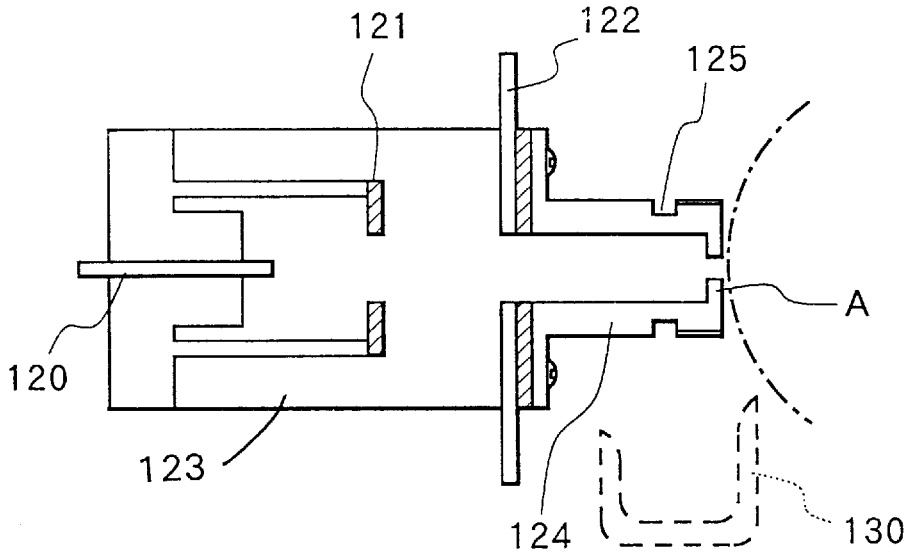
FIG. 1 (a) PRIOR ART
FIG. 1(*a*) is a cross-sectional view showing a conventional ink jet printer.
Figure 1:
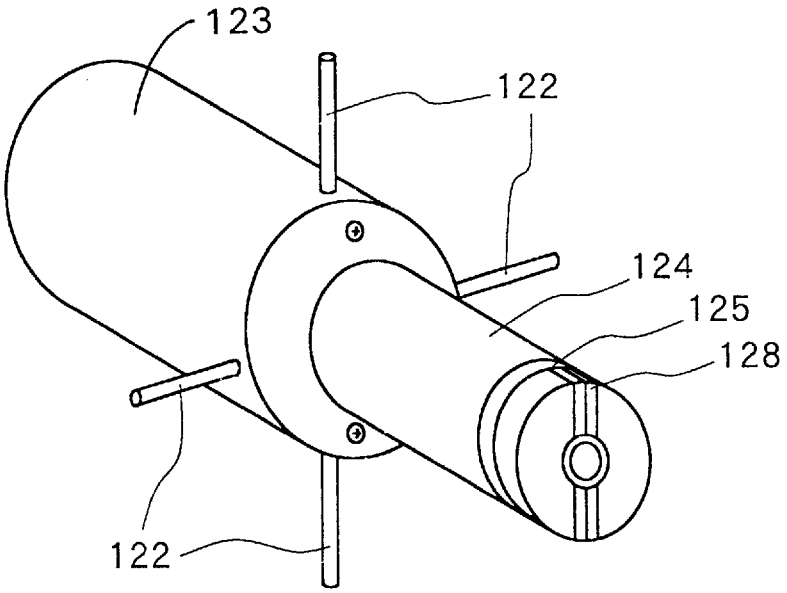
FIG. 1 (b) PRIOR ART
Figure 2:
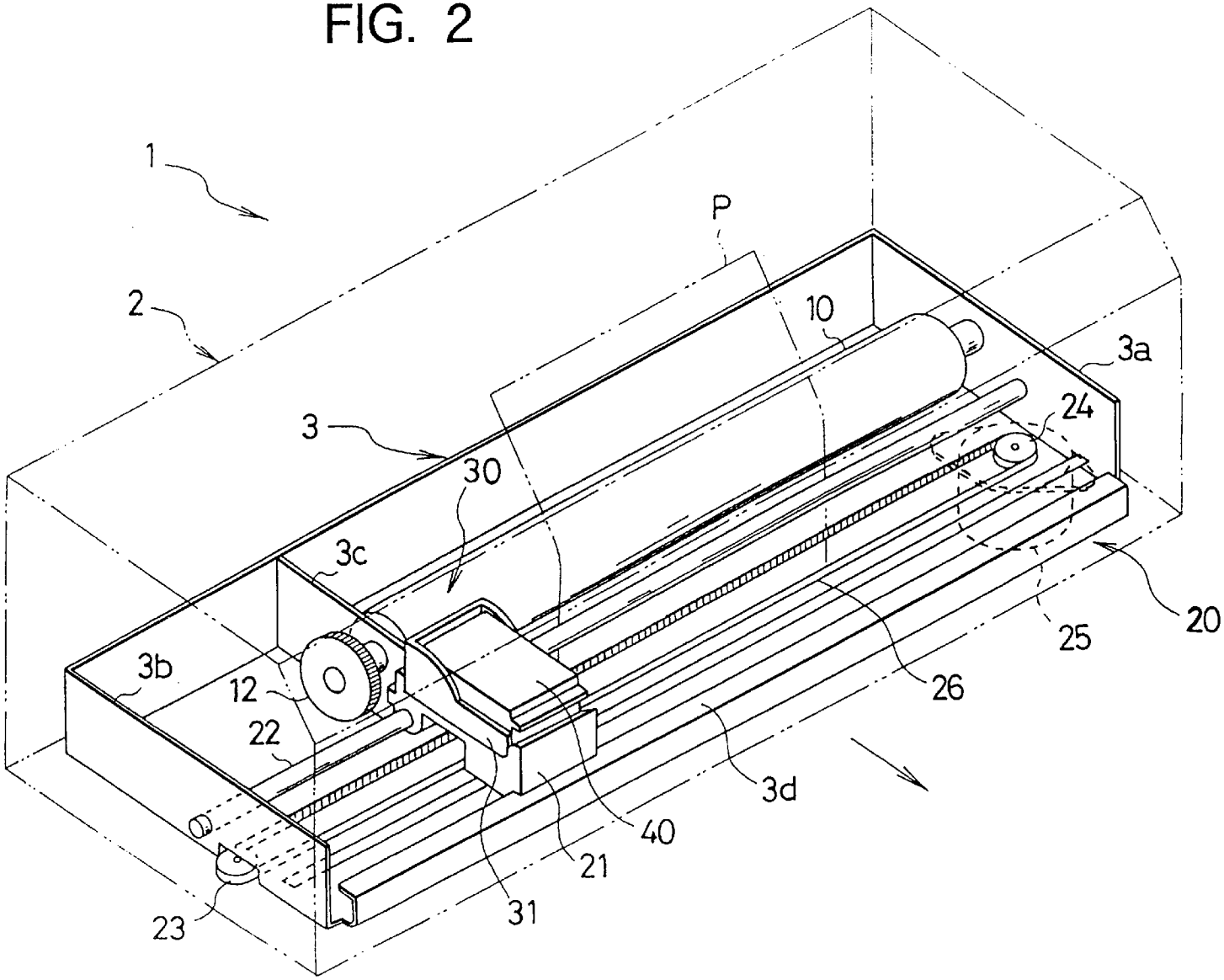
FIG. 2 is a perspective view showing an ink jet recording device according to a preferred embodiment of the present invention.

As shown in FIG. 2, the ink jet recording device 1 is housed in a housing 2. The recording device 1 includes a platen 10 rotatably supported by a frame 3, a carriage 21 reciprocally movable along the platen 10, a carriage drive mechanism 20 for driving the carriage 21, and an ink ejection mechanism 30 for ejecting ink droplets toward a recording paper P.

Figure 3:
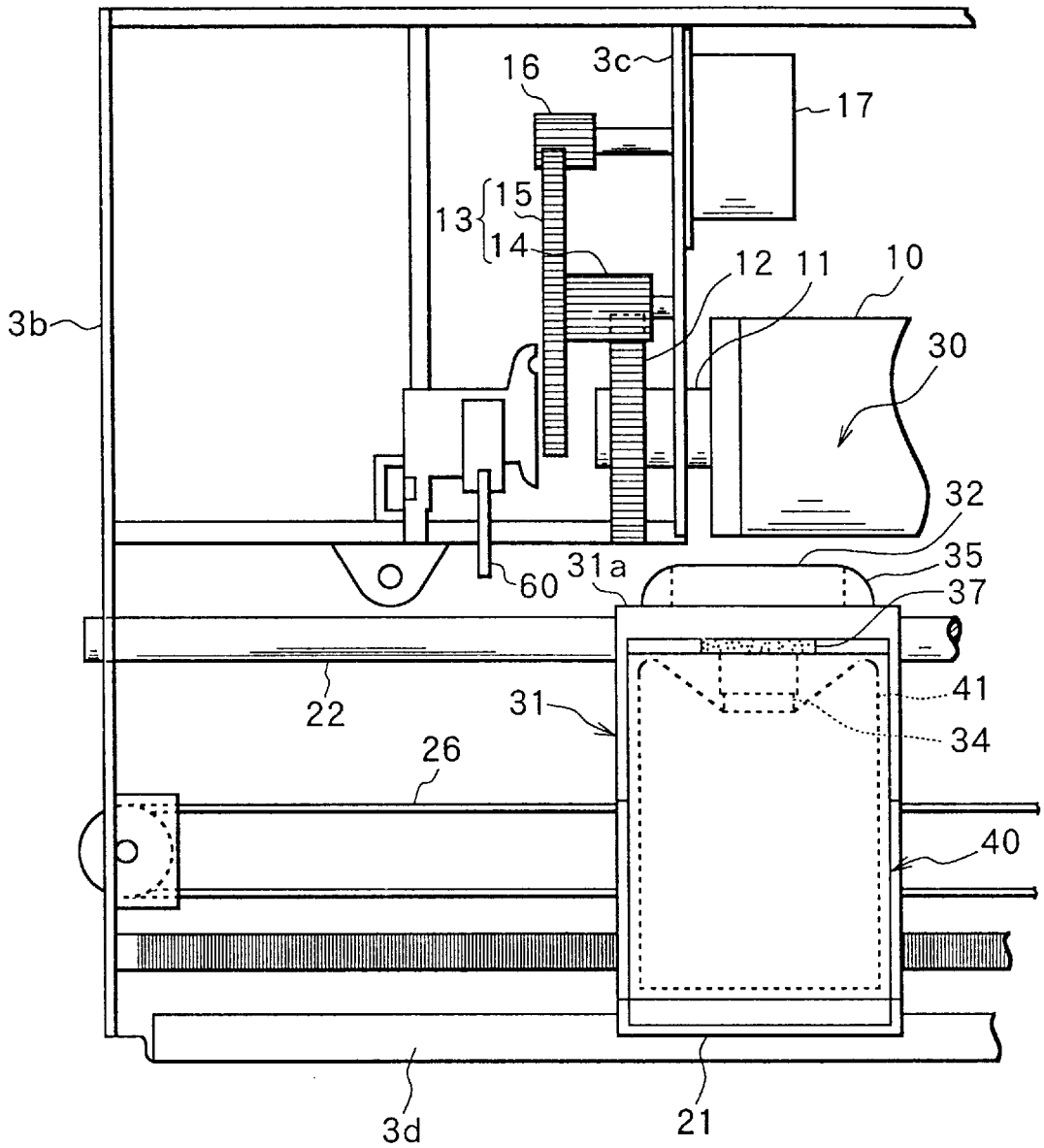
FIG. 3 is a plan view showing a part of the ink jet recording device shown in FIG. 2.
Figure 4:
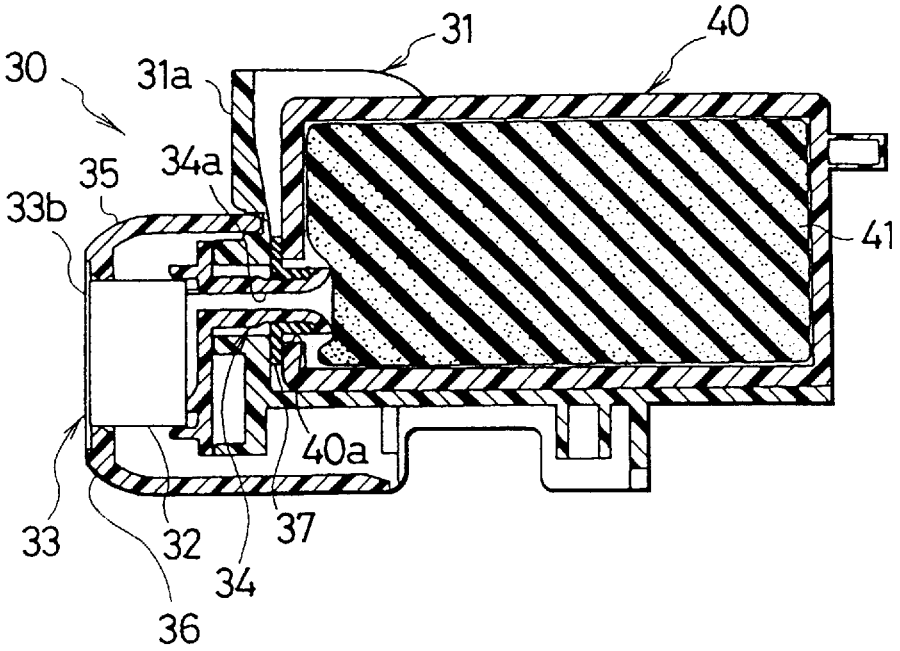
FIG. 4 is a vertical cross-sectional view showing an ink ejection mechanism used in the ink jet recording device shown in FIG. 2.

The platen 10 is made from a rubber. As shown in FIG. 3, the platen 10 has a shaft 11 whose both ends are rotatably supported by side frames 3*a* and 3*c*. A platen gear 12 is rigidly attached to the left end portion of the platen shaft 11. Gear trains 13 including a first driven gear 14 and a second driven gear 15 are rotatably supported by the side frame 3*c*. The first driven gear 14 meshingly engages the platen gear 12. The first driven gear 14 and the second driven gear 15 are integral with each other in coaxial relation. The second driven gear 15 meshingly engages a drive gear 16 that is secured to the rotation shaft of a feed motor 17. Therefore, the rotations of the feed motor 17 is transmitted to the platen 10 through the gear trains interposed therebetween. The recording paper P supported on the periphery of the platen 10 is fed by the rotations of the platen 10.

As shown in FIG. 2, the carriage 21 is held horizontal and disposed in front of the platen 10. The rear face of the carriage 21 is in parallel with the platen 10. The carriage 21 is slidably movably supported on a guide rod 22 and a guide rail portion 3*d*. The guide rod 22 extends in parallel with the platen shaft 11 and is bridged between the side frames 3*a*, 3*b*. The guide rail portion 3*d* is formed by bending the front edge portion of the frame 3 into an inverted "L" shape.

A driven pulley 23 is rotatably disposed in the leftmost portion of the frame 3. A carriage drive motor 25, which is a stepping motor, is disposed in the rightmost portion of the frame 3. The carriage drive motor 25 has a drive shaft to which a drive pulley 24 is attached. An endless timing belt 26 is stretched between the drive pulley 24 and the driven pulley 23. The carriage 21 is connected to the timing belt 26 at its bottom portion. In accordance with rotations of the carriage drive motor 25, the carriage 21 is reciprocally moved back and forth while being supported by the guide rod 22 and the guide rail 3*d*.

As best shown in FIG. 2, the head holder 31 is mounted on the carriage 21. A box-shaped ink cartridge 40 made from a synthetic resin and containing ink therein is detachably mounted on the head holder 31. The rear portion of the head holder 31 is formed with an upstanding wall 31*a*. A recording head 32 for ejecting ink droplets and a cylindrical joint manifold 34 for supplying ink to the recording head 32 are formed integral with the upstanding wall 31 of the head holder 31.

The recording head 32 has a nozzle plate 33 formed with a plurality of ejection nozzles 33*a*. A plurality of ink channels are formed interiorly of the recording head 32, which are in fluid communication with the respective ones of the ejection nozzles 33*a*. A diaphragm (not shown) formed from a piezoelectric element is provided in the midway of each of the ink channels. A protection member 35 is provided integral with the head holder 31 and to surround the recording head 32 except the nozzle plate 33 in order to protect the recording head 32. The protection member 35 is made from a synthetic resin. The joint manifold 34 is formed with ink supply channels 34*a* that are in fluid communication with the plurality of ink channels formed in the recording head 32. The joint manifold 34 passes through and protrudes frontwardly of the rear wall 31*a*. A seal member 37, that is made from silicon rubber, is attached to the joint manifold 34 to seal a gap between the ink cartridge 40 and the joint manifold 34.

The ink cartridge 40 contains a porous ink absorbing material 41 to store ink therein. When the ink cartridge 40 is mounted on the head holder 31, the joint manifold 34 is brought into engagement the ink cartridge 40. The top end portion of the joint manifold 34 is inserted into the ink cartridge 40 through an ink supply port 40*a* and the ink absorbing material 41 is urged by the joint manifold 34. Ink held in the ink absorbing material 41 is supplied to the recording head 32 through the ink supply channel 34*a*. Ink is ejected from the ejection nozzles 33*a* to record an image on a recording paper P.

A wiper blade 60 and an ink absorbing mechanism (not shown) are disposed in positions outside the recording region, for example, in left side of the platen 10. The wiper blade 60 made from a flexible material wipes the nozzle surface to remove residual ink clinging thereto through the relative movements of the wiper blade 60 and the recording head 32. The ink absorbing mechanism is provided for recovering the clogging of ink in the ejection nozzles 33*a*. This is achieved by absorbing ink through the nozzles while intimately contacting the nozzle surface.

Figure 5:
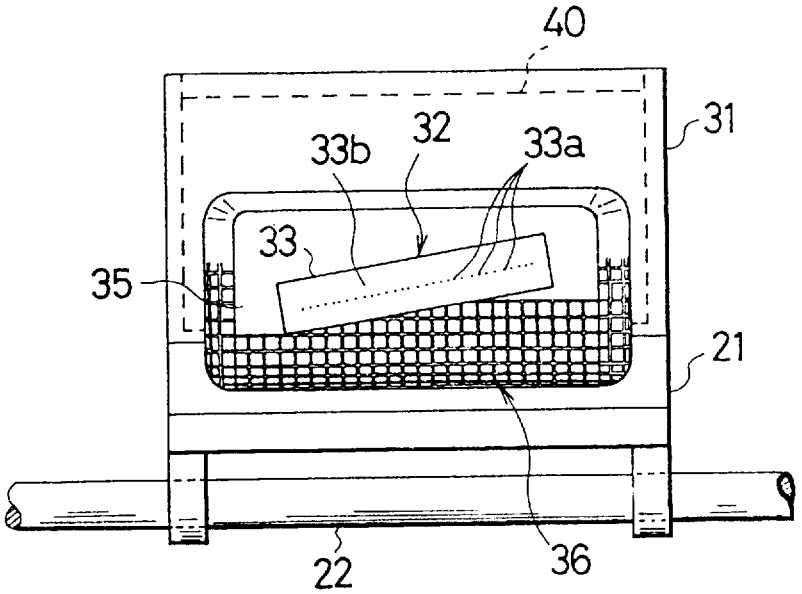
FIG. 5 is a rear view showing a carriage and a head holder used in the ink jet recording device shown in FIG. 2.
Figure 6:
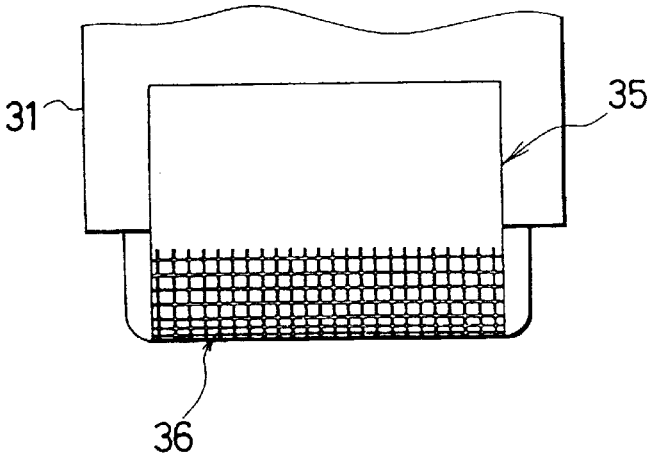
FIG. 6 is a bottom view showing the head holder provided with a recording head.

Ink spreading grooves 36 are partly formed in the protection member 35, for example, to extend horizontally and vertically to form a square-mesh pattern. The ink spreading grooves 36 are formed to be continuous with one another. The grooves 36 operate to spread ink trickling down the surface 33*b* of the nozzle plate 33 and ink expelled by the wiper blade 60 by capillary action of the groove. As shown in FIGS. 5 and 6, the portions where the ink spreading grooves 36 are formed include the lower portion in the surface of the protection member 35 that is lower than the nozzle plate 33, the bottom portion of the protection member 35, and portions at both sides of the recording head 32 of the protection member 35.

More specifically, the protection member 35 has an outer surface made up of an upper portion above the position of the nozzle plate 33, a lower portion below the position of the nozzle plate 33, a left portion leftwardly of the position of the nozzle plate 33, a right portion rightwardly of the position of the nozzle plate 33, a left side portion leftwardly of the position of the nozzle plate 33 and having a surface substantially perpendicular to the surface of the nozzle plate 33, a right side portion rightwardly of the nozzle plate and having a surface substantially perpendicular to the surface of the nozzle plate 33, a top portion above the position of the nozzle plate 33 and having a surface substantially perpendicular to the surface of the nozzle plate 33, and a bottom portion below the position of the nozzle plate 33 and having a surface substantially perpendicular to the surface of the nozzle plate 33. The upper portion, the lower portion, the left portion, and the right portion are substantially flush with the surface of the nozzle plate 33. In this embodiment and a plurality of ink spreading grooves are formed in the lower portion, left portion, left side portion, right portion, right side portion, and the bottom portion of the protection member 35.

When recording operations are performed for a long period of time, ink mist resulting from repetitive ink ejections from respective ones of the plurality of ejection nozzles is accumulated and grown to an ink droplet on the ink ejection surface of the recording head 32. Ink remained upwiped by the wiper blade 60 also grows to an ink droplet on the ink ejection surface. Such ink droplets trickle down the ink ejection surface and are introduced into the ink spreading grooves 36.

The ink introduced into the grooves 36, rapidly spreads horizontally and vertically therealong by capillary action of the grooves 36. Because the ink surface contacting air is largely increased, ink is dried quickly. With the provision of the ink spreading grooves 36, ink does not drip from the recording head 32 and thus the frame 3 and the recording paper P are prevented from being smudged by the ink.

The residual ink clinging to the ink ejection surface 33*b* is moved horizontally in accordance with the wiping action of the wiper blade 60. The ink is introduced into the spreading grooves 36 formed beyond the recording head 32, spreads along the grooves by the capillary action.

Figure 7:
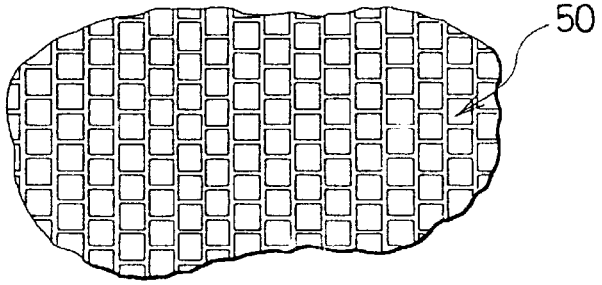
FIG. 7 is a partially enlarged diagram showing ink spreading grooves having a square mesh pattern according to one embodiment of the present invention.
Figure 8:
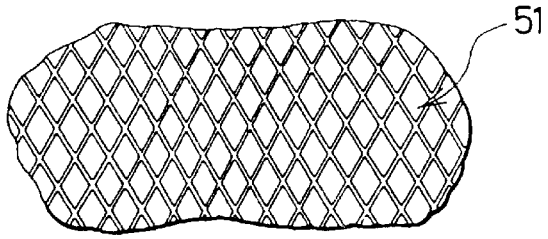
FIG. 8 is a partially enlarged diagram showing ink spreading grooves having a parallelepiped mesh pattern according to another embodiment of the present invention.
Figure 9:
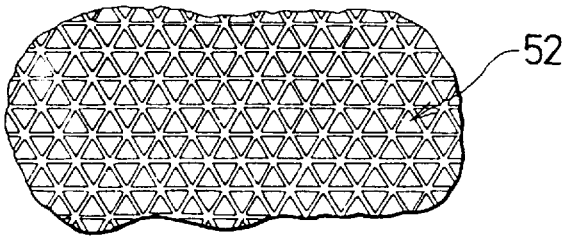
FIG. 9 is a partially enlarged diagram showing ink spreading grooves having a triangular mesh pattern according to still another embodiment of the present invention.
Figure 10:
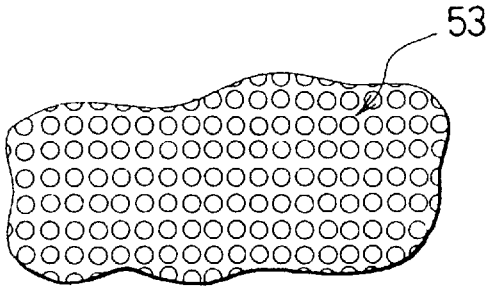
FIG. 10 is a partially enlarged diagram showing ink spreading grooves having a circular mesh pattern according to yet another embodiment of the present invention.

The ink spreading grooves formed in the lower portion of the recording head 32 may have a square or rectangular mesh pattern denoted by reference numeral 50 in FIG. 7, a parallelepiped mesh pattern denoted by reference numeral 51 in FIG. 8, a triangular mesh pattern denoted by reference numeral 52 in FIG. 9, or a circular mesh pattern denoted by reference numeral 53 in FIG. 10. In the embodiment shown in FIG. 7, a plurality of closed non-groove areas surrounded by the ink spreading grooves are a square-shape similar to those shown in FIG. 6, however, the square-shape non-groove areas in adjacent two vertical lines are shifted. In the embodiment shown in FIG. 10, the grooves are formed between regularly formed minute circular projections. In any of the groove patterns 50 through 53, the ink dripped down from the recording head 32 spreads along the grooves, thus the dripped ink dries quickly.

As described, the ink spreading grooves are formed in a selected area in the protection member 35 so that ink dripped down from the recording head 32 or ink collected by the wiper blade 60 is introduced into the grooves. Because the ink quickly spreads along the grooves and the surface of the ink exposed in the air is increased, the ink will be quickly dried. The formation of the ink spreading grooves does not allow the ink to drip onto the frame or the recording paper. Therefore, the frame or the recording paper is not smudged by the ink.

While various exemplary embodiments of this invention have been described in detail, those skilled in the art will recognize that there are many other possible modifications and variations which may be made in these exemplary embodiments while yet retaining many of the novel features and advantages of the invention. For example, high density grooves may be formed in portions where an amount of dripping ink is large while forming normal density grooves in the remainder. The ink spreading grooves may not be formed in the left and right portions and left and right side portions for the structure in which the wiper blade is not provided. Further, although in the embodiments described above, the ink spreading grooves extend substantially straightly, they may be curved to increase the density of the groove. The present invention is also applicable to various types of ink jet printers capable of performing color printing.

What is claimed is:

1. An ink jet recording device comprising:

a recording head including a nozzle plate attached to a position on a surface of said recording head, said nozzle plate having a surface formed with a plurality of nozzles from which ink droplets are ejected; and a protection member surrounding said recording head so as to expose the surface of said nozzle plate, said protection member having an outer surface, wherein the outer surface of said protection member is substantially flush with the surface of said nozzle plate, and a plurality of ink spreading grooves are formed in at least a part of the outer surface of said protection member, said plurality of ink spreading grooves forming a continuous network of grooves in which each of the grooves intersects a plurality of others of the grooves and promoting evaporation of residual ink clinging to the surface of said nozzle plate by receiving the residual ink and spreading all the received residual ink therealong by capillary action of said plurality of ink spreading grooves, said plurality of ink spreading grooves holding all of the received residual ink until all of the received residual ink evaporates.

2. The ink jet recording device according to claim 1, wherein the outer surface of said protection member has a flat portion below the position of said nozzle plate, and said flat portion is formed with said plurality of ink spreading grooves for receiving residual ink trickling down the surface of said nozzle plate.

3. The ink jet recording device according to claim 2, wherein the outer surface of said protection member has a bottom surface substantially perpendicular to the surface of said nozzle plate, and said plurality of ink spreading grooves extend to the bottom surface.

4. The ink jet recording device according to claim 3, further comprising a wiping member for wiping the residual ink clinging on the surface of said nozzle plate, and wherein the outer surface of said protection member has side surfaces substantially perpendicular to the surface of said nozzle plate, and said plurality of ink spreading grooves extend to the side surfaces for receiving the residual ink wiped by said wiping member.

5. The ink jet recording device according to claim 1, wherein said plurality of ink spreading grooves extend substantially straightly.

6. The ink jet recording device according to claim 5, wherein said plurality of ink spreading grooves are divided into at least two groups, each of said at least two groups including a part of said plurality of ink spreading grooves extending in parallel with one another.

7. The ink jet recording device according to claim 6, wherein the part of said plurality of ink spreading grooves in one group intersect with another part of said plurality of ink spreading grooves in another group.

8. The ink jet recording device according to claim 7, wherein said plurality of ink spreading grooves are in a mesh pattern forming a plurality of closed non-groove areas surrounded by said plurality of ink spreading grooves wherein each of said plurality of closed non-groove areas is a square shape.

9. The ink jet recording device according to claim 7, wherein said plurality of ink spreading grooves are in a mesh pattern forming a plurality of closed non-groove areas surrounded by said plurality of ink spreading grooves wherein each of said plurality of closed non-groove areas is a rectangular shape.

10. The ink jet recording device according to claim 7, wherein said plurality of ink spreading grooves are in a mesh pattern forming a plurality of closed non-groove areas surrounded by said plurality of ink spreading grooves wherein each of said plurality of closed non-groove areas is a parallelepiped shape.

11. The ink jet recording device according to claim 7, wherein said plurality of ink spreading grooves are in a mesh pattern forming a plurality of closed non-groove areas surrounded by said plurality of ink spreading grooves wherein each of said plurality of closed non-groove areas is a triangular shape.

12. The ink jet recording device according to claim 7, wherein said plurality of ink spreading grooves are in a mesh pattern forming a plurality of closed non-groove areas surrounded by said plurality of ink spreading grooves wherein each of said plurality of closed non-groove areas is a circular shape.

13. An ink jet recording device comprising:

a frame;

a platen rotatably supported by said frame, said platen having a longitudinal axis;

a carriage disposed in confronting relation with said platen and movable along the longitudinal axis of said platen;

a carriage drive mechanism for moving said carriage;

a recording head mounted on said carriage, said recording head including a nozzle plate attached at a position on a surface of said recording head, said nozzle plate having a surface formed with a plurality of nozzles from which ink droplets are ejected;

an ink cartridge mounted on said carriage, said ink cartridge containing ink therein and being in fluid communication with said recording head to supply ink thereto;

a wiping member mounted on said frame for wiping residual ink clinging to the surface of said nozzle plate; and a protection member surrounding said recording head so as to expose said nozzle plate, said protection member having an outer surface made up of an upper portion above the position of said nozzle plate, a lower portion below the position of said nozzle plate, a left portion leftwardly of the position of said nozzle plate, a right portion rightwardly of the position of said nozzle plate, a left side portion leftwardly of the position of said nozzle plate and having a surface substantially perpendicular to the surface of said nozzle plate, a right side portion rightwardly of said nozzle plate and having a surface substantially perpendicular to the surface of said nozzle plate, a top portion above the position of said nozzle plate and having a surface substantially perpendicular to the surface of said nozzle plate, and a bottom portion below the position of said nozzle plate and having a surface substantially perpendicular to the surface of said nozzle plate, wherein said upper portion, said lower portion, said left portion, and said right portion are substantially flush with the surface of said nozzle plate, and a plurality of ink spreading grooves are formed at least in said lower portion of said protection member, said plurality of ink spreading grooves forming a continuous network of grooves in which each of the grooves intersects a plurality of others of the grooves and promoting evaporation of residual ink clinging to the surface of said nozzle plate by receiving the residual ink and spreading all the received residual ink therealong by capillary action of said plurality of ink spreading grooves, said plurality of ink spreading grooves holding all of the received residual ink until all of the received residual ink evaporates.

14. The ink jet recording device according to claim 13, wherein said plurality of ink spreading grooves extend said left portion, said right portion, said left side portion, said right side portion, and said bottom portion.

15. The ink jet recording device according to claim 14, wherein said wiping member wipes the surface of said nozzle plate and the residual ink expelled by said wiping member is introduced into said plurality of ink spreading grooves formed at least one of said left portion and said right portion.

16. The ink jet recording device according to claim 15, wherein said plurality of ink spreading grooves extend substantially straightly.

17. The ink jet recording device according to claim 16, wherein said plurality of ink spreading grooves are divided into at least two groups, each of said at least two groups including a part of said plurality of ink spreading grooves extending in parallel with one another.

18. The ink jet recording device according to claim 17, wherein the part of said plurality of ink spreading grooves in one group intersect with the part of said plurality of ink spreading grooves in another group.

19. The ink jet recording device according to claim 1, wherein the plurality of ink spreading grooves are in a mesh pattern.

20. The ink jet recording device according to claim 13, wherein the plurality of ink spreading grooves are in a mesh pattern.

21. An ink jet recording device comprising:

a frame;

a recording head mounted on said frame and including a nozzle plate attached to a position on a surface of said recording head, said nozzle plate having a surface formed with a plurality of nozzles from which ink droplets are ejected; and a protection member surrounding said recording head so as to expose the surface of said nozzle plate, said protection member having an outer surface including a lower surface located below said nozzle plate, the lower surface extending in a widthwise direction, wherein a plurality of ink spreading grooves are formed in a widthwise direction in a region extending across the lower surface, said plurality of ink spreading grooves forming a continuous network of grooves in which each of the grooves intersects a plurality of others of the grooves and promoting evaporation of residual ink clinging to the surface of said nozzle plate by receiving the residual ink and spreading all the received residual ink therealong by capillary action of said plurality of ink spreading grooves, said plurality of ink spreading grooves holding all of the received residual ink until all of the received residual ink evaporates.

22. The ink jet recording device according to claim 21, wherein the lower surface of said protection member has a flat portion substantially flush with the surface of said nozzle plate.

23. The ink jet recording device according to claim 22, wherein the outer surface of said protection member has a bottom surface substantially perpendicular to the surface of said nozzle plate, and said plurality of ink spreading grooves extend to the bottom surface.

24. The ink jet recording device according to claim 23, wherein the outer surface of said protection member has side surfaces substantially perpendicular to the surface of said nozzle plate, and said plurality of ink spreading grooves further extend to the side surfaces.

25. The ink jet recording device according to claim 21, further comprising a wiping member mounted on said frame for wiping the residual ink clinging on the surface of said nozzle plate.

26. The ink jet recording device according to claim 21, wherein the plurality of ink spreading grooves are in a mesh pattern.

27. The ink jet recording device according to claim 24, further comprising a wiping member mounted on said frame for wiping the residual ink clinging on the surface of said nozzle plate, wherein said plurality of ink spreading grooves extending to the side surfaces receive the residual ink wiped by said wiping member.

28. The inkjet recording device of claim 1, wherein the network of grooves is formed in substantially all of the outer surface of said protection member, said network of grooves promoting evaporation of residual ink clinging to the surface of said nozzle plate by receiving the residual ink clinging to the surface of the nozzle plate, excessively running out of the plurality of nozzles, formed from ink mist occurring when ink droplets are ejected, and remaining on the surface of the nozzle plate after wiping by a wiping member.

29. The ink jet recording device of claim 13, wherein the network of grooves is formed in substantially all of said lower portion of said protection member, said network of grooves promoting evaporation of residual ink clinging to the surface of said nozzle plate by receiving the residual ink clinging to the surface of the nozzle plate, excessively running out of the plurality of nozzles, formed from ink mist occurring when ink droplets are ejected, and remaining on the surface of the nozzle plate after wiping by the wiping member.

30. The ink jet recording device of claim 21, wherein the network of grooves is formed in a widthwise direction in a region extending across substantially all of the lower surface, said network of grooves promoting evaporation of residual ink clinging to the surface of said nozzle plate by receiving the residual ink clinging to the surface of the nozzle plate, excessively running out of the plurality of nozzles, formed from ink mist occurring when ink droplets are ejected, and remaining on the surface of the nozzle plate after wiping by a wiping member.

* * * * *